United States Patent [19]

Sato

[11] 4,314,691

[45] Feb. 9, 1982

[54] JACK

[76] Inventor: Shichiro Sato, 172-14, Shimooichihigashimachi, Nishinomiya, Hyogo, Japan

[21] Appl. No.: 147,638

[22] Filed: May 7, 1980

[30] Foreign Application Priority Data

May 18, 1979 [JP] Japan ..... 54-61178

[51] Int. Cl.[3] ..... B66F 3/00

[52] U.S. Cl. ..... 254/126; 254/8 B

[58] Field of Search ..... 254/2 B, 8 B, 7 B, 124, 254/126, 86 R

[56] References Cited

U.S. PATENT DOCUMENTS

| | | | |
|---|---|---|---|
| 1,559,099 | 10/1925 | Hopkins | 254/2 B |
| 1,821,627 | 9/1931 | Fotheringham | 254/126 |
| 3,337,170 | 8/1967 | Remy et al. | 254/126 |
| 3,854,750 | 12/1974 | Voehringer | 254/86 R |

FOREIGN PATENT DOCUMENTS

| | | | |
|---|---|---|---|
| 452622 | 11/1948 | Canada | 254/7 B |
| 956442 | 1/1957 | Fed. Rep. of Germany | 254/8 B |
| 117957 | 1/1947 | Sweden | 254/8 B |
| 786968 | 11/1957 | United Kingdom | 254/126 |

*Primary Examiner*—Robert C. Watson

*Attorney, Agent, or Firm*—Darby & Darby

[57] ABSTRACT

A jack for raising car bodies in which a threaded-driven movable block screwed on a threaded rod is threadedly moved to cooperate with first and second link means to raise a lifting table adapted to be engaged with car bodies, the first and second link means establishes a proportional relation between the speed of upward travel of the lifting table and the speed of transverse movement of the movable block.

8 Claims, 2 Drawing Figures

JACK

BACKGROUND OF THE INVENTION

In the repair work on automobiles, for example, replacement of punctured tires, it is necessary to use a jack to raise the car body. Heretofore, a pantograph type manually operated screw jack has been used for such work. The pantograph type screw jack comprises a horizontally extending threaded rod, a base disposed below said threaded rod and adapted for placement on the ground, and a lifting table disposed above said threaded rod and adapted for engagement with a car body. The threaded rod has a threaded portion extending from one end toward the middle of said rod, with a thread-driven movable block screwed on said threaded portion. A parallelogram link mechanism is operatively associated with said elements to constitute a pantograph. The link mechanism is composed of four links forming a parallelogram, wherein the upper pair of links have one ends thereof pivotally connected to the lifting table and the other ends thereof pivotally connected respectively to the movable block on the threaded rod and to a fixed block rotatably attached to the other end of the threaded rod, while the lower pair of links have one ends thereof pivotally connected to the base and the other ends thereof pivotally connected respectively to said movable block and to said fixed block.

In the pantograph type screw jack, the threaded rod is rotated by manually operating a crank handle. With the rotation of the threaded rod, the movable block is threadedly moved lengthwise of the threaded rod toward the fixed block, so that the distance between the movable and fixed blocks is reduced. This reduction in the distance between the movable and fixed blocks results in the distance between the lifting table and the base being increased by the parallelogram link mechanism. Accordingly, by manipulating the handle to rotate the threaded rod, it is possible to raise the lifting table relative to the base placed on the ground, so as to raise the car body engaged by the lifting table.

A disadvantage of such pantograph type screw jack is that the amount or speed of upward travel of the lifting rod is not proportional to the amount or speed of rotation of the threaded rod. It is impossible for the parallelogram link mechanism to establish proportional relation between the rate of decrease in the distance between the movable and fixed blocks and the rate of increase in the distance between the lifting table and the base. Assuming that the rate of decrease in the distance between the movable and fixed blocks is constant, the rate of increase in the distance between the lifting table and the base will gradually lower as the distance between the lifting table and the base increases. Accordingly at the start of operation, namely, when the lifting table is positioned at a low level, manipulation of the handle to rotate the threaded rod will raise the lifting table at relatively high speed, but when the lifting table reaches a relatively high level, it will be raised only at low speeds. This means that at the start of operation, manipulation of the handle requires much force and that when the lifting table reaches a relatively high level, the efficiency of operation decreases.

SUMMARY OF THE INVENTION

A principal object of the invention is to provide a novel and improved manually operated screw jack.

Another object of the invention is to provide a novel and improved manually operated screw jack designed so that the lifting table can be raised at a substantially constant speed by rotating the threaded rod at a constant speed.

A further object of the invention is to provide a novel and improved screw jack designed to raise car bodies or other heavy objects with high efficiency of operation and with constant force all the way from the start to the end of operation.

In brief, the invention includes threaded rod means rotatably installed in frame means. A thread-driven movable block is screwed on the threaded portion of said threaded rod means and is adapted to move lengthwise of the threaded rod during rotation of the latter. In this invention, first and second link means are used. The first link means has a predetermined length and is pivotally connected at one end thereof to the movable block. The second link means has a predetermined length and is pivotally connected at one end thereof to the frame means and pivotally connected at the other end thereof to the other end of said first link means. A lifting table is amounted at the point of connection between the other end of the first link means and the other end of the second link means.

DETAILED DESCRIPTION OF THE PREFERRED EMBODIMENTS

Figure 1:
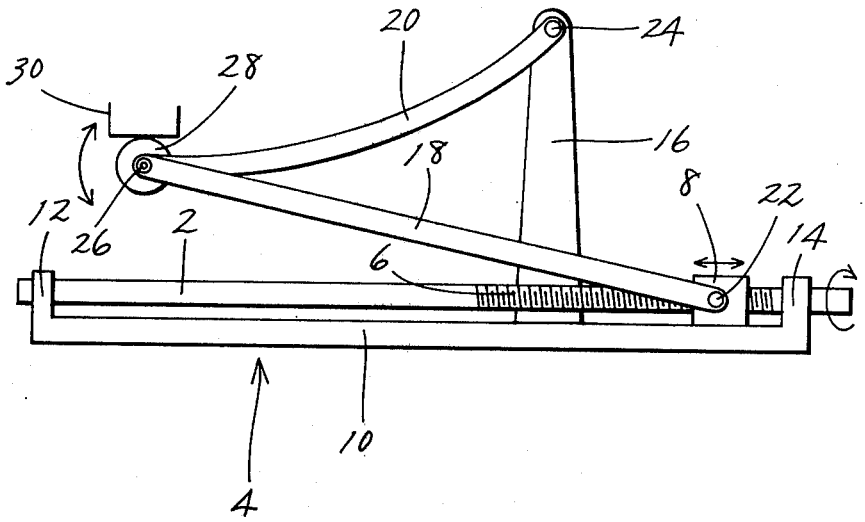
FIG. 1 is a side view of a manually operated screw jack according to the present invention.

Referring to FIG. 1, a manually operated screw jack according to the present invention is shown, which includes a threaded rod 2 rotatably installed in a frame 4. The threaded rod 2 has a threaded portion 6 formed thereon, with a threaded-driven movable block 8 screwed thereon.

The frame 4 includes a horizontally extending base 10 adapted for placement on the ground. The base 10 has a pair of brackets 12 and 14 at opposite ends thereof, with the opposite ends of the threaded rod 2 being rotatably supported in said brackets 12 and 14. The frame 4 further includes an extension 16 vertically extending from the base 10 at a predetermined position between the ends of said base. The threaded portion 6 of the threaded rod 2 is formed between a transverse position adjacent to the right-hand side end of the frame 4 and a transverse position adjacent to the extension 16 of the frame 4. When the threaded rod 2 is rotated, the movable block 8 is threadedly moved by the threaded portion 6 in the direction of the length of the threaded rod 2 and between the ends of the threaded portion 6. The movable block 8 may be placed in sliding engagement with the upper surface of the base 10 of the frame 4 so that the block 8 is guided for movement by the upper surface of the base 10.

According to the invention, first and second link means 18 and 20 are used. The first link means 18 is pivotally connected at one end thereof to the movable block 8 by a pin 22 and extends obliquely upward to the left. The second link means 20 is pivotally connected at one end thereof to the upper end of the extension 16 of the frame 4 by a pin 24 and extends obliquely downward to the left. The first link means 18 is straight, while the second link means 20 is curved. The free ends of the first and second link means 18 and 20 are disposed above the base 10 of the frame 4 and somewhat to the right of the bracket 12 at one end of the base 10 and are pivotally connected together by a pin 26.

A roller or lifting table 28 adapted for engagement with a car body 30 or the like is mounted on a pin 26 at the free ends of the link means 18 and 20.

When a crank handle (not shown) connected to the threaded rod 2 is manually operated to rotate the threaded rod 2, the movable block 8 is moved lengthwise of the threaded rod 2 from the starting position, close to the right-hand end of the threaded portion 6, to the terminal position, close to the left-hand end of the threaded portion 6, whereby the lifting table 28 is pushed up by the first link means 18. The movement of the lifting table 28 is limited by the second link means 20 such that the lifting table 28 is raised along an arcuate path with the radius defined by the length of the second link means 20. The position of the lifting table 28 is determined by the transverse position of the movable block 8 and the lengths of the first and second link means 18 and 20. In this embodiment, the arrangement is such that when the movable block 8 moves from the starting position, close to the right-hand end of the threaded portion 6, to the terminal position, close to the left-hand end of the threaded portion 6, the lifting table 28 rises from a lower end position below the level of the point of connection between the second link means 20 and the upper end of the extension 16 of the frame 4, namely, the pin 24, to an upper end position above said level.

Figure 2:
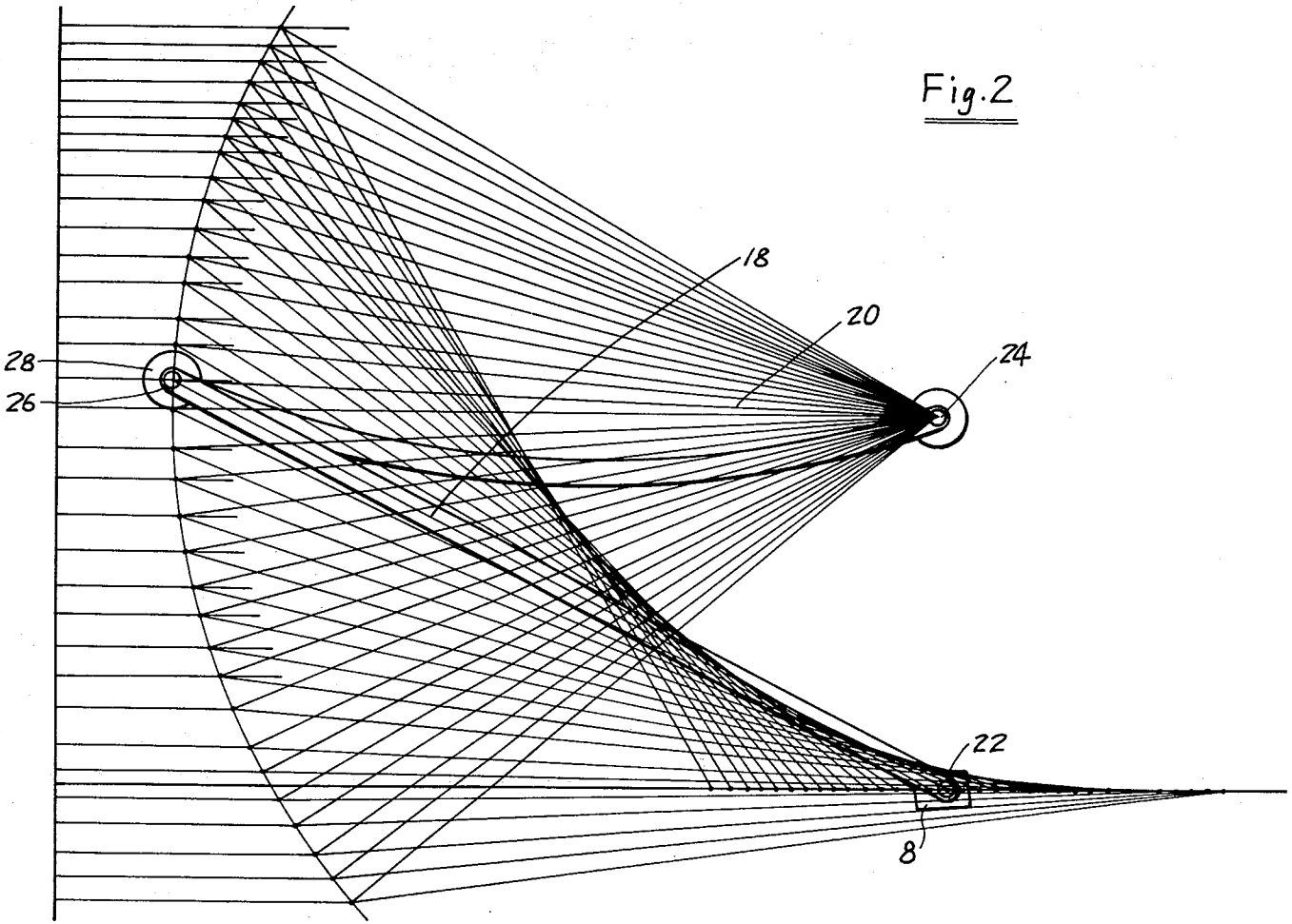
FIG. 2 is a diagrammatic view showing various levels assumed by a lifting table relative to the transverse position of a movable block shown in FIG. 1.

FIG. 2 diagrammatically shows various levels assumed by the lifting table 28 relative to the transverse position of the movable block 8. As is apparent from the figure, all the way from the lower end position to the upper end position, the lifting table 28 rises with its amount, namely rate, of upward travel approximately proportional to the amount, namely rate, of movement of the movable block 8. This means that the force needed to manipulate the crank handle to rotate the threaded rod 2 so as to move the movable block 8 and the efficiency of operation concerning the amount of upward travel of the lifting block relative to the amount of manipulation of the crank handle are maintained constant throughout the operation. Accordingly, it is possible for the operator to raise the car body engaged by the lifting block 28 with substantially constant labor expended from first to last and with an unchanging relatively high efficiency of operation. It is to be understood that the above detailed description of an embodiment of the invention is provided by way of example only. Various details of design and construction may be modified without departing from the true spirit and scope of the invention as set forth in the appended claims.

What we claim is:

1. A jack for lifting an object comprising:

a member movable in one direction relative to the object;

a lift member to engage the object and movable generally perpendicular to said one direction between extended and retracted positions in response to movement of said member;

first and second links for moving said lift member, said first link being pivotally connected at one end to said member, and said second link being pivotally connected at one end to the other end of said first link and at the other end to a fixed point above said first link, said first and second links forming an angle between them which is maintained substantially constant throughout the range of movement of said lift member.

2. A jack as defined in claim 1, comprising a frame, a threaded rod rotatably installed in said frame and extending substantially longitudinally along the frame, and in which said frame comprises a base section defining the longitudinal axis o the frame and having a pair of brackets at its opposite longitudinal ends between which said threaded rod is rotatably supported, and a raised section extending outwardly from a predetermined position between said opposite ends of said base section, said other end of said second link being pivotally connected to the upper end of said raised section.

3. A jack as defined in claim 2, in which the threaded portion of said rod extends from adjacent one end of said base section to a position adjacent said raised section, and said lift member is disposed to be raised and lowered from a position substantially adjacent to the other end of said base section.

4. A jack as defined in claim 1, in which said first and second links extend substantially in the direction of movement of said member and define an acute angle with a limited range therebetween, the respective lengths of said links being such that said lift member is moved between a lower position below the level of the point of connection between said second link and said fixed point and an upper position above the level of said point of connection at a speed substantially proportional to that of said member.

5. A jack as defined in claim 1, in which the effective length of said second link is smaller than that of said first link.

6. A jack as defined in claim 5, in which said second link is formed in an upwardly concave shape.

7. The jack of claim 2 in which said member is a block rotatably engaging the rotatable threaded rod.

8. The jack of claim 1 in which said lift member is situated at the point in interconnection of said first and second links.

* * * * *